United States Patent [19]

Williams et al.

[11] Patent Number: 4,493,383

[45] Date of Patent: Jan. 15, 1985

[54] WELL CLEAN OUT TOOL

[75] Inventors: Robert M. Williams; Bob Davis, both of Hobbs, N. Mex.

[73] Assignee: Bull Dog Tool Inc., Hobbs, N. Mex.

[21] Appl. No.: 501,917

[22] Filed: Jun. 7, 1983

[51] Int. Cl.[3] ..... E21B 37/00

[52] U.S. Cl. ..... 175/234; 166/105.1; 166/107; 166/311

[58] Field of Search ..... 166/311, 105, 107, 105.1, 166/105.2, 105.3; 175/234; 166/105.4; 417/448; 92/78

[56] References Cited

U.S. PATENT DOCUMENTS

| | | | |
|---|---|---|---|
| 544,148 | 8/1895 | Welter et al. | 166/107 X |
| 1,423,935 | 7/1922 | Hopkins et al. | 166/105.2 |
| 2,237,686 | 4/1941 | Parr | 166/107 |
| 2,785,756 | 3/1957 | Reynolds | 166/107 |
| 4,190,113 | 2/1980 | Harrison | 166/107 X |
| 4,421,182 | 12/1983 | Moody et al. | 166/105.1 X |

*Primary Examiner*—James A. Leppink
*Assistant Examiner*—Michael Starinsky
*Attorney, Agent, or Firm*—Burns, Doane, Swecker & Mathis

[57] ABSTRACT

The present invention relates to a well clean out tool comprising an elongated body having first and second ends and being adapted to be received within a well borehole. The elongated body is comprised of a plurality of subs including a first sub at a lower portion of the body having a one way valve for permitting only upward flow of fluid. A second sub is arranged above the first sub for receiving and retaining fluid and debris passing through the first sub while a third sub is arranged above the second sub. The third sub includes a second valve for permitting flow only upwardly through the third sub. A fourth or pumping sub is arranged above the third sub with the fourth sub including an outlet for returning fluid to the borehole. The pump sub includes an elongated hollow piston reciprocatingly driven within a casing of the fourth sub. During the upstroke of the piston, fluid and debris pass upwardly through the first second and third subs while during downward movement of the piston fluid is prevented from flowing downwardly by the valves and flows upwardly through a valve in the hollow piston toward the outlet of the tool.

9 Claims, 6 Drawing Figures

Fig. 1
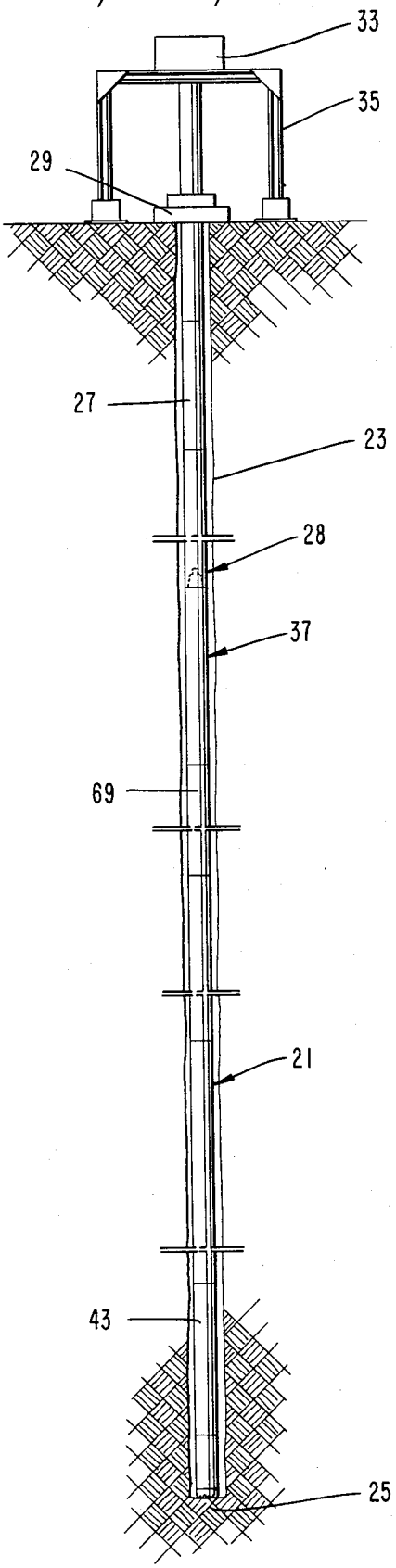
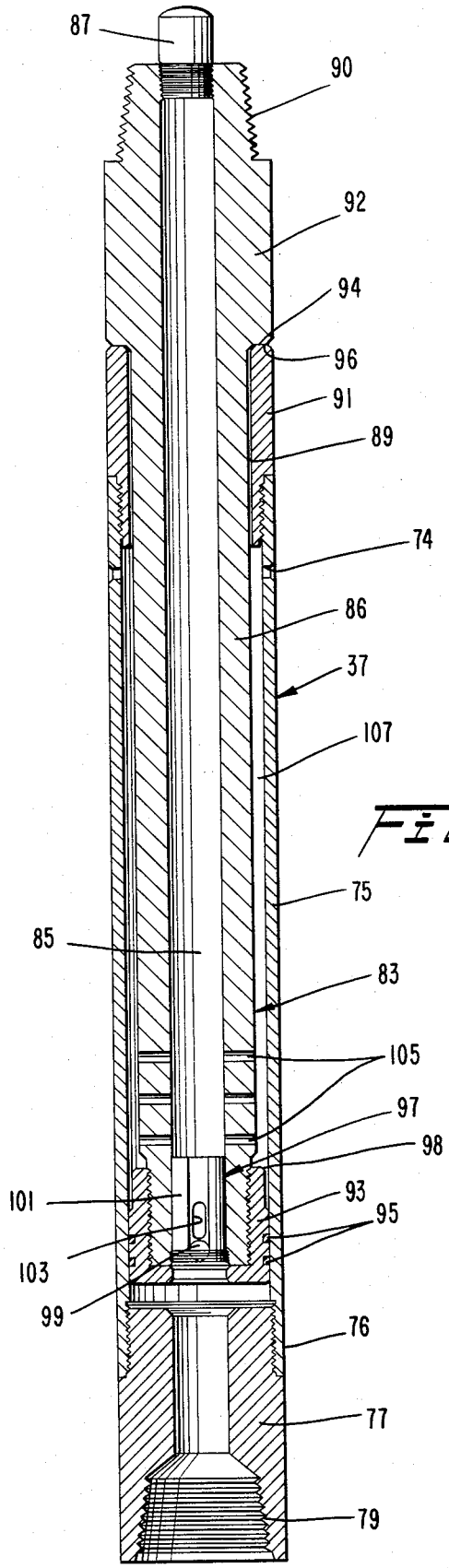
Fig. 3

87
90
37
53'
69
61
59
65
61
63
61
61
59
53
43
45
39
41

WELL CLEAN OUT TOOL

BACKGROUND AND SUMMARY OF THE PRESENT INVENTION

The present invention relates generally to a well clean out tool. More particularly, the present invention relates to a tool for removing sand and other debris from a column of water within a borehole of a well.

During well drilling, service and workover operations, quantities of sand and other solid materials along with large quantities of water tend to collect during certain procedures in the bottom of a borehole or on top of various tools in the borehole. In order to continue the desired operations, it is necessary to remove the sand and other solid material from the water within the borehole. Accordingly, it is desirable to provide a relatively simple tool for effectively removing such debris from the well.

Various well clean out tools or sand pumps have been proposed. However, some of the prior art pumps have been either complex or prone to breakage. Further, some of the prior art arrangements have required a large hydrostatic head in order to operate properly.

One prior art tool is disclosed in U.S. Pat. No. 4,190,113 issued Feb. 26, 1980 to Harrison. The well clean out tool in the Harrison patent comprises an elongated main body having a lower inlet end and an upper outlet end. A pump is provided at an upper end of the body for pumping fluid from the inlet through a chamber for retaining debris and out through the outlet. The pump includes a piston which reciprocates in a cylinder. The piston has a one-way valve therein which admits flow upwardly through the piston into the cylinder space above the piston, but prevents flow downwardly through the tool, Openings are provided in the cylinder walls and form the outlet of the tool. A piston rod attached to the piston is reciprocated to pull fluid up through the tool to be forced outwardly through the outlet openings upon an upstroke of the piston. The Harrison patent is limited to a well clean out tool including a stop arranged on the piston rod for jarringly engaging an upper closure member to provide a jarring action.

Another known sand pump, similar to that disclosed in the Harrison patent, is disclosed in U.S. Pat. No. 3,138,215 issued to June 23, 1964 to Cook. The Cook patent discloses a sand pump including a plurality of pistons slidably arranged upon a plunger shaft. A plurality of valves adapted to cooperate with the movable pistons are secured to the plunger shaft. The uppermost valve acts as a stop and is securely arranged upon the plunger.

Still a further sand pump or bailer similar to the Harrison patent is disclosed in U.S. Pat. No. 2,237,686 issued April 8, 1941 to Parr. The bailer in the Parr patent includes a barrel within which a reciprocable plunger is arranged. The plunger is operated by a cable extending to the surface and secured to one end of a stem having its other end secured to the plunger. Another sand pump is disclosed in U.S. Pat. No. 2,171,539 issued Sept. 5, 1939 to Burns. The Burns patent discloses two telescopic sections which define a pump. The pump also includes a pair of arms which are adapted to be swung upwardly during pumping action of the device to hold one of the telescopic sections within the well during the pumping stroke.

Other patents related in general to sand pumps and the like are disclosed in U.S. Pat. Nos. 563,055 issued June 30, 1896 to Palm; 1,537,201 issued May 12, 1925 to Swan; 2,000,750 issued May 7, 1935 to Gates; 2,180,935 issued Nov. 21, 1939 to Dumble; and 2,182,374 issued Dec. 5, 1939 to Dumble.

Accordingly, it is an object of the present invention to provide an improved clean out tool for wells.

A further object of the present invention is to provide a well clean out tool that is relatively simple in construction yet is strong and reliable in operation.

Still a further object of the present invention is to provide a well clean out tool which is efficient in operation and does not require a large hydrostatic head or large amounts of power to operate.

These objects and others are accomplished by a well clean out tool according to the present invention. The tool includes an elongated body having first and second ends adapted to be received within a well borehole. The elongated body is comprised of a plurality of subs secured together. A first sub at a lower portion of the body near the first end includes an inlet for fluid and debris from the well borehole. The first sub also includes a first valve for permitting flow toward the second end and for preventing fluid flow toward the first end. A second sub arranged above the first sub receives and retains fluid and debris passing through the first sub. A third sub arranged above the second sub includes a second valve for permitting flow toward the second end and for preventing flow toward the first end of the elongated body. A fourth sub is arranged above the third sub with the fourth sub including an outlet for returning fluid to the well bore.

The fourth sub further includes a pump for drawing fluid into the inlet and through the first, second and third subs out through the outlet. The pump comprises an elongated hollow piston which is reciprocatingly driven in relation to a casing of the fourth sub. A third valve at an end of the piston remote from the second end of the elongated body is provided for permitting flow into the interior of the piston and for preventing flow out through the end of the piston. The outlet comprises a plurality of openings in a longitudinal piston wall above the lower end of the piston and passages through the casing of the fourth sub near an upper end of the fourth sub.

In a preferred embodiment, the first and second valves each comprise a spring-biased flap valve. Such a flap valve permits substantially free passage of water and debris through the valve toward the second end of the elongated body while effectively preventing flow of fluid toward the first end. Still further, the third valve preferably comprises a ball and seat arrangement within the end of the piston.

Further in the preferred embodiment, an additional sub is arranged below the first sub that is adapted to engage solid material at the bottom of the borehole or an upper end of tools in the borehole. The additional sub may be a rock bit, fishing tool or another similar device.

In addition, an arrangement for guiding the piston during reciprocation is preferably provided along with an arrangement for closing an upper end of the hollow piston. The arrangement for guiding the piston also permits rotation of the entire tool when desired by rotation of the piston.

BRIEF DESCRIPTION OF THE DRAWINGS

A preferred embodiment of the present invention will be described in greater detail with reference to the accompanying drawings, wherein like members bear like reference numerals, and wherein:

FIG. 1 is a schematic view of a well clean out tool according to the present invention arranged within a borehole;

FIG. 3 is a cross-sectional view of a pump sub forming a portion of the well clean out tool;

DETAILED DESCRIPTION OF THE PREFERRED EMBODIMENT

Figure 2:
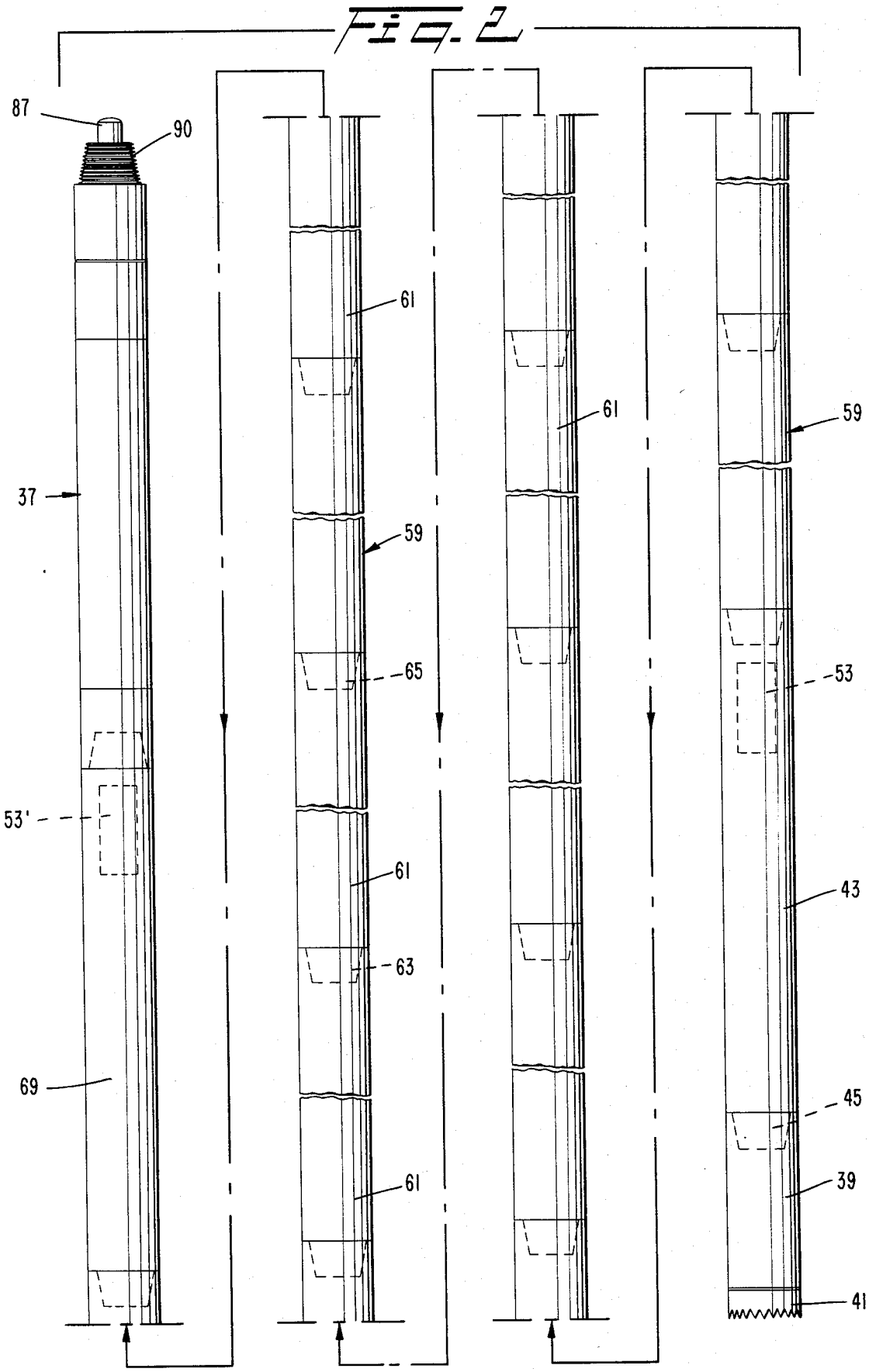
FIG. 2 is an expanded view of the well clean out tool of FIG. 1.

With reference to FIG. 1, a well clean out tool 21 according to the present invention is arranged within a borehole 23 of a well. A lower end of the tool 21 rests upon solid material 25 at the bottom of the borehole 23 or on top of tools arranged in the borehole 23. Suitable tubing 27 is secured by a connecting arrangement 28 to an upper end of the tool 21 and extends upwardly out of the borehole 23. Alternatively, a string or cable may be attached to the upper end of the tool 21 and run upwardly to the surface.

The tubing 27 passes through suitable guides 29 and is attached to a driving arrangement 33, such as a hoisting mechanism. The driving arrangement 33 is secured to a suitable fixed support 35 and is adapted to drive the tubing 27 in reciprocating motion within the borehole 23. Such reciprocation of the tubing 27 or cable secured to the upper end of the tool 21 causes a pump sub 37 (FIG. 3) of the tool 21 to draw water and debris through the lower end of the tool 21 as will be described in more detail hereinafter.

The well clean out tool 21 according to the present invention comprises an elongated body having a plurality of subs secured together. With reference to FIG. 2, the well clean out tool 21 has an open bottom sub 39 including a ground or tool engaging portion 41. The passage of water and debris is freely permitted through the open bottom of the bottom sub 39. The ground engaging portion 41 may be a tri-cone rock bit, a fishing tool or another suitable device for penetrating through relatively loose material within the borehole 23 and contacting the solid material 25. Alternatively, the tool engaging portion 41 may be a suitable implement for engaging the top of other tools arranged in the borehole 23.

Figure 5:
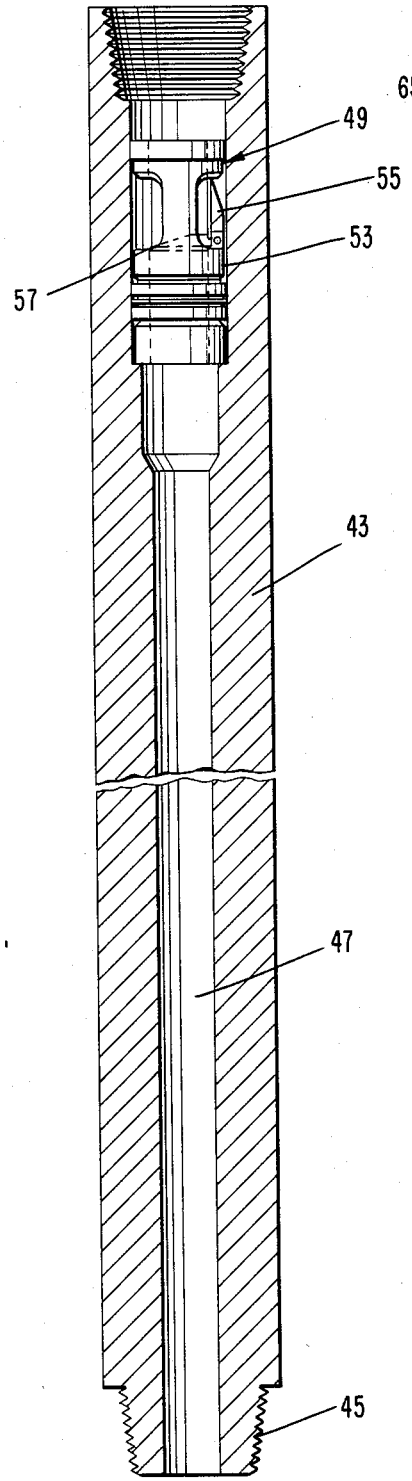
FIG. 5 is a cross-sectional veiw of a lower sub of the well clean out tool including a valve.

Arranged above the bottom sub 39 is a first float sub 43 (FIG. 5). The first float sub 43 includes an elongated body portion having an externally threaded portion 45 at a lower end thereof adapted to engaged corresponding internal threads on the bottom sub 39. The lower end of the first float sub 43 is open to provide an inlet for water and debris into the tool 21. With reference to FIG. 5, the first float sub 43 includes a bore 47 extending therethrough with a one-way valve 49 arranged at an upper end of the first float sub 43. The valve 49 is preferably secured within an enlarged portion 51 of the bore 47. The valve 49 is adapted to permit flow of fluid and debris in an upward direction while preventing flow of fluid and debris in the reverse, downward direction.

In a preferred embodiment, the valve 49 comprises a sleeve member 53 which is fitted within the enlarged bore portion 51. A flap valve 55 is pivotably arranged within the sleeve 53 and is adapted to move between a generally vertical, open position (shown in solid lines) to a generally horizontal, closed position (shown in dotted lines). In the vertical position of the flap valve 55, fluid and debris is freely permitted to flow through the interior of the sleeve 53 to an upper end of the first float sub 43. In the horizontal position of the flap valve 55, flow of fluid downwardly through the sleeve 53 is prevented by engagement of the flap valve 55 with a suitable seat 57. In the preferred embodiment, the flap valve 55 is biased by a spring (not shown) toward the closed, horizontal position. The pivotable flap valve 55 is preferred since it does not present a substantial restriction to upward flow, particularly sand and other debris. A valve arrangement which has been found particularly suitable for use as the valve 49 is a Baker Model "G" full-flow drill pipe float valve—Product No. 480-15. However, other valves which permit relatively free flow in one direction and prevent flow in the other direction are suitable.

Figure 6:
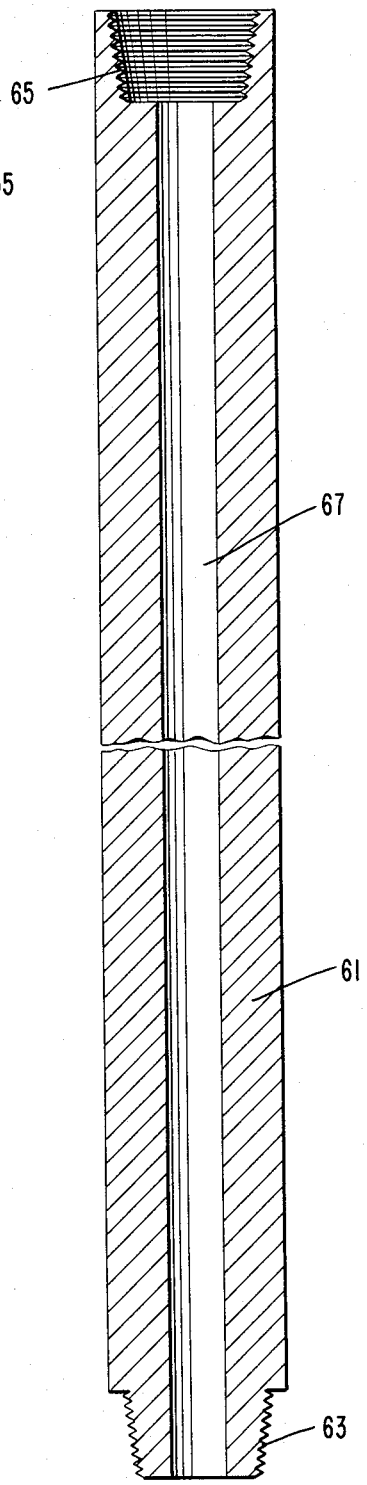
FIG. 6 is a cross-sectional view of an intermediate sub of the well clean out tool.

Secured above the first float sub 43 is a second sub 59 which acts as a reservoir for receiving and retaining fluid and debris passing through the first float sub 43. The second sub 59 is comprised of a plurality of individual pipe sections 61 (FIG. 6) which are adapted to be secured to one another. Each of the sections 61 includes a bore 67 and external threads 63 at a lower end thereof which are adapted to engage internal threads 65 at an upper end of an immediately adjacent section 61. In a preferred embodiment, the sections 61 have an internal bore 67 of nominal $2\frac{3}{8}$ or $2\frac{7}{8}$ inches outside diameter tubing or such other diameters as may be suitable for the size of the borehole 23.

The number of individual sections 61 within the second sub 59 is determined by the depth of water within the borehole 23. The length of the second sub 59 may be several hundred feet if necessary. In other words, individual sections 61 are progressively added to the tool as the tool is lowered into the borehole to ensure contact of ground engaging portion 41 of the bottom sub 39 with the solid material 25 at the bottom of the borehole 23 and to provide sufficient reservoir space for retaining the quantity of debris contained in the borehole 23. The debris from the borehole is retained within the individual sections within the bores 67 therein.

Again with reference to FIG. 2, arranged above the uppermost section 61 of the second sub 59 is a third sub 69 which is generally similar to the first float sub 43. The third sub 69 includes external threads 71 at a lower end thereof for engagement with the internal threads 65 of the uppermost section 61 of the second sub 59. The third sub 69 also includes a one-way valve 49' including a sleeve member 53' and a flap valve 55'. The valve 49' in the third sub 69 may be identical in construction with the one way valve 49 in the first float sub 43. The valve 49' is also adapted to permit flow in an upward direction past the flap valve 55' through the third sub 69 while preventing downward flow through the valve 49' towards the second sub 59. The valve 49' is preferably secured within an enlarged bore 51' in the third sub 69 in a manner similar to that the valve 49 of the first float sub 43.

Figure 4:
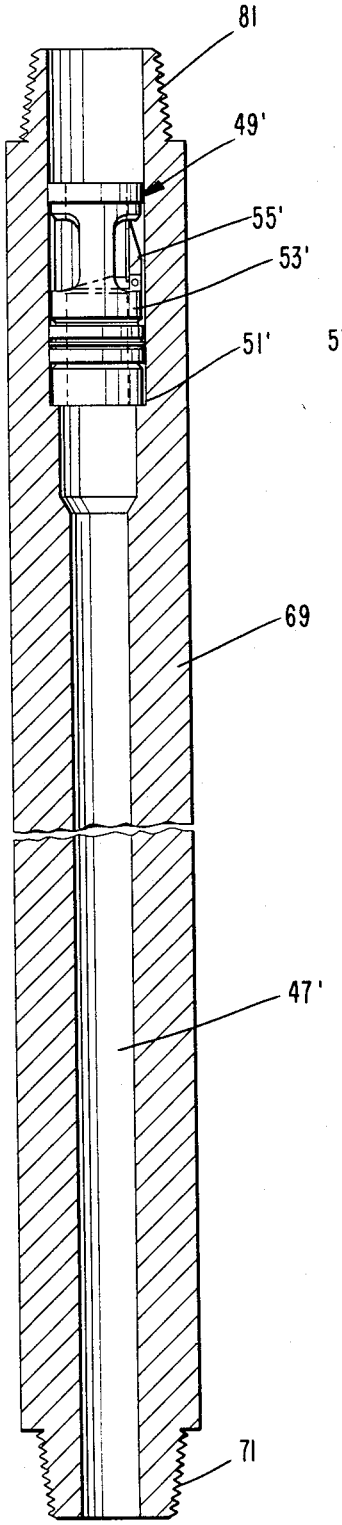
FIG. 4 is a cross-sectional view of a sub located below the pump sub and containing a valve.

Secured to an upper end of the third sub 69 is the pump or fourth sub 37. With reference to FIG. 3, the pump sub 37 includes an outer cylindrical casing or sleeve 75 with a connecting member 77 secured to a lower end 76 thereof. The connecting member 77 includes suitable threads 79 for engaging complimentary threads 81 on an upper end of the third sub 69 (FIG. 4). A plurality of radial openings 74 are provided at an upper end of the casing 75 to permit the free outflow of fluid from the interior of the casing 75.

Slidably arranged within the outer cylindrical sleeve 75 is a piston 83. The piston 83 includes an elongated, hollow body having longitudinal walls 86 with a bore 85 extending longitudinally therethrough. An upper end of the bore 85 is closed by a plug 87 or another suitable arrangement to prevent free inflow of fluid into the interior bore 85 of the portion 83. The elongated piston body is preferably in the form of a polygon, e.g., a hexagon, and is adapted to cooperate with a corresponding polygonal bore 89 in a guide member 91. The guide member 91 is secured in a suitable manner to an upper end of the sleeve 75. In this way, reciprocation of the piston 83 is more carefully controlled due to the cooperating surfaces of the piston 83 and the guide member 91.

Also, the cooperating hexagonal surfaces of the guide member 91 and the piston 83 permit rotation of the entire tool 21 upon rotation of the piston 83. Such rotation is highly desirable for agitation and/or manipulation of the ground or tool engaging portion 41 at the bottom of the tool 21. This rotational agitation permits the tool to be worked downward through loose material in the borehole 23. Also, the rotation of the tool may loosen the tool itself or loosen material stuck in the inlet. It should be noted that a sufficient clearance exists between the exterior surface of the piston walls 86 and the internal surface of the polygonal bore 89 to permit the passage of fluid therethrough.

An enlargement 92 is provided near an upper end of the piston 83. A lower edge 94 of the enlargement 92 abuts an upper end 96 of the guide member 91 to limit downward movement of the piston 83. Also, the upper end of the piston 83 is provided with threads 90 to define the connecting arrangement 28 for securing the additional tubing 27 extending to the surface (FIG. 1).

At a lower end of the piston 83, a seal carrier 93 is fixedly secured. The seal carrier 93 includes at least one sealing ring 95 arranged within an outer peripheral groove to sealingly engage the internal walls of the outer cylindrical sleeve 75 to prevent the free passage of fluid past the piston 83. Also, an upper edge 98 of the seal carrier 93 is adapted to abut a lower edge of the guide member 91 to limit upward movement of the piston 83.

Arranged at a lower end of the piston bore 85 is a valve member 97 which permits flow of fluid from the lower end of the piston 83 into the bore 85 while preventing flow in the opposite direction. In a preferred embodiment, the valve member 97 includes a ball and seat valve arrangement 99 arranged within a cage 101. The cage 101 is secured within the end of the piston 83 in any suitable manner. The cage 101 includes a plurality of openings 103 for permitting flow of fluid when the ball of the ball and seat valve arrangement 99 is moved upwardly in response to a pressure differential across the ball away from engagement with the seat. A ball and seat valve arrangement found to be particularly adapted for use in the present invention is manufactured by Harbison-Fisher.

The piston 83 also includes a plurality of radial bores 105 extending through the walls 86 of the piston 83 to communicate the interior bore 85 with an annular space 107 between the outer surface of the piston walls 86 and the inner wall surface of the outer cylindrical sleeve 75. The openings or bores 105 are preferably arranged closely adjacent the lower end of the piston 83 for reasons which will be explained more fully subsequently. In the preferred embodiment, at least six openings 105 of approximately ½ inch in diameter are provided in piston walls 86 to ensure sufficient flow from the bore 85. In this way, fluid is permitted to flow past the ball and seat arrangement 99 through the openings 103 in the cage 101 into the internal bore 85 of the piston 83. Thereafter, fluid is free to flow outwardly from the bore 85 through the openings 105 into the annular space 107, and through the openings 74 in the casing 75. Also, a portion of the fluid escapes through the space between the guide member 91 and the outer surface of the piston wall 86 to the exterior of the tool 21.

In a preferred embodiment, it has been found that a Bowen fishing bumper sub (part number 29766) may be modified to provide the pump sub 37 according to the present invention. In particular, the Bowen fishing bumper sub must be inverted from its usual operating orientation. In addition, the plug member 87 must be inserted within the bore 85 and the openings 105 must be provided within the walls 86 of the piston 83. Further, a knocker which is provided with the fishing bumper sub is bored to receive the ball and seat valve arrangement 99 and the cage 101. It should be noted that the Bowen fishing bumper sub in ordinary use is used for bumping or jarring a drill string containing fishing tools. In other words, in ordinary operation, the fishing bumper sub does not operate as a pump.

In operation of the well clean out tool 21 according to the present invention, the first float sub 43 is secured to a suitable bottom sub 39 with a desired ground or tool engaging member 41 secured thereto. A plurality of individual pipe sections 61 are secured together to form the second sub 59 of suitable length for the height of water contained in the borehole 23 to be cleaned. The third or upper float sub 69 is secured to the uppermost one of the sections 61 of the second sub 59 and the pump sub 37 is secured to an upper end of the third sub 69. The tubinq 27 (or the cable) is secured to the upper end of the pump sub 37.

The entire tool 21 is progressively lowered, by sequential attachment of the various subs noted above, into the borehole 23 utilizing the tubing 27. It should be noted that during lowering of the tool 21, the piston 83 of the pump sub 37 is in its uppermost position with the upper edge 98 of the seal carrier 93 engaging the lower edge of the guide member 91. When the bottom sub 39 engages the solid material 25 at the bottom of the borehole 23, further lowering of the tubing 27 lowers the piston 83 downwardly within the pump sub 37 until the lower edge 94 of the enlargement 92 engages the upper end 96 of the guide member 91. In order to ensure that the tool 21 is in contact with the solid material 25, rotation of the tool 21 by rotation of piston 83 may be required. It should be noted that during lowering of the tool 21 water and debris is permitted to pass through the inlet in the bottom sub 39, through the one-way valve 49 in the first sub 43 upwardly through the sections 61 of the second sub 59 and through the valve 49' in the third sub 69 due to the arrangement of the valves 49, 49'.

In order to initiate the pumping action, the tubing 27 is reciprocated by the driving arrangement 33 in a known manner over a distance sufficient to utilize substantially the whole stroke of the piston 83 and the pump sub 37. In the preferred embodiment, the stroke of the piston 83 is approximately 5 feet. In other words, the tubing 27 (or the cable) is pulled upwardly a distance generally corresponding to the distance between the upper edge 98 of the seal carrier 93 and the lower edge of the guide member 91. As the piston 83 is pulled upwardly, a suction is created beneath the piston 83 thereby drawing water and debris from the borehole 23 through the inlet of the bottom sub 39, through the valve 49 of the first float sub 43 and into the second sub 59. Also, fluid and debris are pulled upwardly into the third sub 69. It should be noted that, due to the weiqht of the debris and the length of the second sub 59, substantial quantities of debris do not ordinarily reach the third sub 69. Thereafter, fluid is drawn upwardly through the one way valve 49' into the connecting member 77 of the pump sub 37 and into the interior of the outer cylindrical casing or sleeve 75 of the fourth sub 37.

After reaching the top of the stroke of the piston 83, the piston 83 moves downwardly thereby pressurizing the fluid contained within the outer cylindrical sleeve 75. Such pressurization closes the valve 49' in the third sub 69 to prevent flow of fluid downwardly past the valve 49'. The valve 49 in the first float sub 43 closes due to both the pressure exerted by the column of water in the second sub 59 and the action of the spring on the flap valve 55 to prevent the outflow of debris from the second sub or reservoir 59.

The pressurization of the fluid beneath the piston 83 serves to urge the ball of the ball and seat valve arrangement 99 away from the seat and upwardly within the cage 101. In this way, a portion of the fluid trapped between the closed valve 49' of the third sub 69 and the lower end of the piston 83 is permitted to flow past the seat of the ball and seat valve arrangement 99, through the openings 103 and into the internal bore 85 of the piston 83. Another portion of the fluid flows outwardly into the borehole 23 through the openings 74 in the casing 75.

As the piston 83 continues downwardly, fluid flow is forced radially outwardly from the bore 85 through the openings 105 into the borehole 23. It should be noted that during initial downward movement of the piston 83, at least a portion of the openings 105 are above the upper end of the guide member 91. In this way, the initial outflow of fluid through the openings 105 is enhanced. Upon further downward movement of the piston 83, the fluid continues to flow outwardly through the openings 105 in the piston walls 86, upwardly through the annular space 107 surrounding the piston 83 and outwardly into the borehole 23 primarily through the openings 74. A portion of the fluid also leaves the pump sub 37 through the clearance between the cooperating surfaces of the guide member 91 and the walls 86 of the piston 83. Since the openings 105 in the piston walls 86 are arranged closely adjacent the lower end of the piston 83, the length of the fluid outflow path from the bore 85 of the piston 83 is minimized at all times during the downward movement of the piston 83.

It should be noted that since the hydrostatic head above the piston 83 is substantially balanced by the hydrostatic pressure of the fluid below the piston 83, upward movement of the piston 83 under the urging of the tubing 27 does not require large amounts of energy. Also, back pressure in the casing 75 is reduced due to the constant outflow of fluid through the openings 74 during downward movement of the piston 83. Further, the downward movement of the piston 83 is aided by the weight of the piston itself. In other words, by providing an elongated piston 83, the weight of the piston 83 is increased thereby facilitating downward movement of the piston 83 and increasing the outflow speed of the fluid through the internal bore 85 and the openings 105 in the piston walls 86. Still further, due to the relatively large area within the internal bore 85 of the piston 83, pumping losses occasioned by the downward movement of the piston are minimized.

The piston 83 is continuously reciprocated by the driving arrangement 33 until all of the debris has been transferred from the borehole 23 into the reservoir or second sub 59. Thereafter the entire tool 21 is removed from the borehole 23 to permit other desired operations to be undertaken.

The present invention provides a relatively simple yet effective tool for cleaning out a borehole of a well. Further, the well clean out tool according to the present invention can be constructed from readily available parts thereby minimizing the overall cost of the tool. In other words, no special tooling is required to construct the well clean out tool according to the present invention. Still further, due to the arrangement of the valves, the well clean out tool according to the present invention ensures that the debris which is pulled into the interior of the tool 21 does not flow outwardly back into the borehole 23. Also, the preferred flap valves 55, 55' ensure easy upward flow while effectively preventing unwanted downward flow of debris.

The principles, preferred embodiment and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A well clean out tool comprising:

an elongated body having first and second ends and being adapted to be received within a well borehole, said elongated body being comprised of a plurality of subs secured together;

a first sub at a lower portion of the body near the first end, the first sub having an inlet for receiving fluid and debris from the borehole, the first sub further including first flap valve means pivotally mounted within the first sub between a horizontal closed position and a vertical open position for permitting flow toward the second end and for preventing fluid flow toward the first end, said first flap valve being biased toward the closed position;

a second sub arranged above said first sub for receiving and retaining fluid and debris passing through said first sub;

a third sub arranged above said second sub, said third sub having second flap valve means for permitting flow toward the second end and for preventing flow toward the first end;

a fourth sub having a casing and being arranged above said third sub, said fourth sub including outlet means for returning fluid to the borehole, and pump means within said casing for drawing fluid into said inlet and through said first, second and third subs and out through said outlet means;

said pump means including an elongated piston having an internal bore, said piston being reciprocatingly driven in relation to said casing of the fourth sub;

third valve means at an end of the piston facing the third sub for permitting relatively free flow into the internal bore of said piston and preventing flow from said bore out through said end of the piston; and the outlet means comprising a plurality of unrestricted openings through a longitudinal piston wall above said third valve means and closely adjaent said end of piston, an annular space between an outer surface of the piston and the casing, said outlet means further comprising unrestricted openings in the casing of the fourth sub near an upper end of the fourth sub, said openings being arranged to minimize a length of the fluid outflow path from the internal bore to the outside of the casing.

2. The well clean out tool of claim 1, further comprising a bottom sub arranged below the first sub for engaging a solid surface in the borehole.

3. The well clean out tool of claim 2, wherein the bottom sub includes a rock bit to engage the solid surface.

4. The well clean out tool of claim 1, wherein the third valve means comprises a ball and seat valve arrangement.

5. The well clean out tool of claim 1, further comprising means for guiding the piston during reciprocating movement of the piston and for permitting rotation of the tool by rotation of the piston.

6. The well clean out tool of claim 5, wherein additional outlet passages are defined between the guiding means and the piston wall.

7. The well clean out tool of claim 1, further comprising first and second stops for limiting upward and downward movement, respectively, of the piston relative to the casing.

8. The well clean out tool of claim 1, further comprising means for sealing the end of the piston relative to the casing.

9. The well clean out tool of claim 1, wherein the second sub includes a plurality of individual, interconnected pipe sections.

* * * * *